US005972133A

United States Patent [19]

Kambara

[11] Patent Number: 5,972,133

[45] Date of Patent: Oct. 26, 1999

[54] METHOD FOR PRODUCING INTERMETALLIC COMPOUND

[75] Inventor: Syozo Kambara, Tanashi, Japan

[73] Assignee: Japan Energy Corporation, Tokyo, Japan

[21] Appl. No.: 08/838,026

[22] Filed: Apr. 22, 1997

[51] Int. Cl.[6] ..... C21D 1/09

[52] U.S. Cl. ..... 148/525; 148/565

[58] Field of Search ..... 148/525, 565

[56] References Cited

FOREIGN PATENT DOCUMENTS

| | | |
|---|---|---|
| 1222002 | 9/1989 | Japan . |
| 2212396 | 8/1990 | Japan . |
| 7-17970 | 3/1995 | Japan . |

*Primary Examiner*—Sikyin Ip

*Attorney, Agent, or Firm*—Birch, Stewart, Kolasch & Birch, LLP

[57] ABSTRACT

At least one intermetallic compound $A_{m1}B_{n1}$ (n1/m1>n0/m0) having a constitutional ratio of a metal B higher than that of an intermetallic compound $A_{m0}B_{n0}$ is melted two or more times in a high vacuum atmosphere by using an electron beam. The metal B is gradually evaporated in accordance with passage of melting time. Thus, the composition of the intermetallic compound can be adjusted to be $A_{m0}B_{n0}$. $NbAl_3$ and $Nb_2Al$ are used as starting materials, which are heated to an approximately intermediate temperature between melting points of them to obtain a single-phase of $Nb_2Al$. Alternatively, $Nb_3Al$ and $Nb_2Al$ are used as starting materials, which are heated to an approximately intermediate temperature between melting points of them to obtain a single-phase of $Nb_3Al$. It is possible to perform purification for removing impurities, and it is easy to adjust the stoichiometric ratio of the intermetallic compound.

19 Claims, 2 Drawing Sheets

TWO-PHASE DIAGRAM OF Nb-Al

METHOD FOR PRODUCING INTERMETALLIC COMPOUND

BACKGROUND OF THE INVENTION

1. Field of the Invention

The present invention relates to a method for producing an intermetallic compound. In particular, the present invention relates to a method for producing an intermetallic compound having a desired composition by melting an intermetallic compound by means of an electron beam.

2. Description of the Related Art

Those hitherto known as methods for producing intermetallic compounds such as those based on a Nb—Al system include a powder metallurgy method and a pressurized atmosphere melting method for melting a material while adjusting a pressurized condition of a rare gas such as Ar. These methods are designed to obtain an intermetallic compound containing components in a desired stoichiometric ratio by controlling the amount of evaporation of a readily volatile metal which is relatively easy to evaporate, such as Al.

Japanese Patent Publication No. 7-17970 discloses a plasma electron beam melting and casting method for Al-containing intermetallic compounds, in which a compressed preparation of a material of an intermetallic compound is melted in a water-cooled horizontal copper mold to obtain a rod-shaped ingot, and the ingot is melted by irradiating it with a plasma electron beam to perform solidification while dripping the melted metal. In this method, evaporation of Al is controlled by finely adjusting the flow amount of an inert gas to be introduced when the ingot is irradiated with the plasma electron beam.

However, in the case of the powder metallurgy method, the grain boundary tends to become brittle due to intergranular oxidation, and an obtained intermetallic compound is insufficient in processability. If a third component is added in order to improve the processability, characteristics originally possessed by the intermetallic compound may be deteriorated. On the other hand, the pressurized atmosphere melting method is excellent in adjustment of the stoichiometric ratio, however, it is impossible to expect any purification effect for removing impurity gas elements by means of volatilization. In the conventional methods as described above, mechanical and physical characteristics inherent in a material itself are not embodied due to the occurrence of fracture in the grain boundary itself and the influence exerted by contained impurities, in addition to the characteristic fracture mechanism based on the cleavage property inherent in the intermetallic compound.

SUMMARY OF THE INVENTION

An object of the present invention is to provide a method for producing an intermetallic compound, which makes it possible to perform purification for removing impurity gases, and easily adjust the stoichiometric ratio of components contained in the intermetallic compound, and in which the obtained intermetallic compound has its original characteristics.

According to a first aspect of the present invention, there is provided a method for producing an intermetallic compound $A_{m0}B_{n0}$ composed of a metal A and a metal B, comprising the steps of:

using, as a starting material, at least one intermetallic compound $A_{m1}B_{n1}$ (n1/m1>n0/m0) having a constitutional ratio of the metal B higher than that of the intermetallic compound $A_{m0}B_{n0}$; and melting the intermetallic compound $A_{m1}B_{n1}$ by means of an electron beam to obtain the intermetallic compound $A_{m0}B_{n0}$.

According to a second aspect of the present invention, there is provided a method for producing an intermetallic compound $A_{m0}B_{n0}$ composed of a metal A and a metal B, comprising the steps of:

using, as a starting material, a mixture of at least one intermetallic compound $A_{m1}B_{n1}$ (n1/m1>n0/m0) having a constitutional ratio of the metal B higher than that of the intermetallic compound $A_{m0}B_{n0}$, and the intermetallic compound $A_{m0}B_{n0}$; and melting the starting material by means of an electron beam to produce the intermetallic compound $A_{m0}B_{n0}$ composed of a single-phase.

FIG. 2 shows a phase diagram illustrating intermetallic compounds based on an Nb—Al system as one objective of production according to the present invention. With reference to FIG. 2, melting points of Nb and Al are 2469° C. and 661.4° C. respectively. Thermodynamically, the amount of volatilization and evaporation of Al is about one thousand times or more as compared with Nb. Therefore, how to control the evaporation of Al comes to question. In the case of a method in which a starting material obtained by mixing Nb and Al components in a stoichiometric ratio is simply melted with the electron beam, all of Al can be evaporated in an equilibrium state, judging from a thermodynamic point of view. In the present invention, a button electrode for the electron beam melting step is processed as follows. Namely, an intermetallic compound based on the Nb—Al system in a stable phase (including a metastable state) is previously produced in accordance with the arc button melt method. The intermetallic compound in the stable phase is used as a starting material for the electron beam melting step. Thus, it is possible to obtain the intermetallic compound based on the Nb—Al system having a desired composition. In an embodiment described later on, $NbAl_3$, which resides in a stable phase in FIG. 2, is used as a starting material for the electron beam melting step. Accordingly, the electron beam is used to hold $NbAl_3$ at a temperature which is not less than a eutectic temperature of $NbAl_3$ and $Nb_2Al$ and not more than a peritectic temperature of $Nb_2Al$ and $Nb_3Al$, and Al is evaporated from the system while gradually causing phase transformation from $NbAl_3$ to $Nb_2Al$. Thus, a single-phase intermetallic compound of $Nb_2Al$ is obtained. The single-phase intermetallic compound of $Nb_2Al$ is also obtained in accordance with the same method by using, as a starting material, a mixed phase of stable phase $NbAl_3$ and stable phase $Nb_2Al$. Especially, it has been found in the present invention that there is a correlation between the melting time based on the use of the electron beam and the phase and the Al concentration of the intermetallic compound obtained after solidification, owing to the use of the intermetallic compound in the stable phase as described above as the starting material. The composition of the intermetallic compound can be controlled by performing the electron beam melting step on the basis of the correlation. In the same manner as described above, the obtained single-phase $Nb_2Al$ can be further subjected to a melting operation in accordance with the electron beam melt process. In this operation, the heating temperature is adjusted at a temperature between the peritectic temperature of $Nb_2Al$ and $Nb_3Al$ and a peritectic temperature of $Nb_3Al$ and Nb. Alternatively, when $Nb_2Al$ and $Nb_3Al$ are used as starting materials, the electron beam melting step is performed at a heating temperature between the peritectic temperature of $Nb_2Al$ and $Nb_3Al$ and the peritectic temperature of $Nb_3Al$ and Nb. Thus, single-phase $Nb_3Al$ can be also produced.

In the method for producing the intermetallic compound according to the present invention, it is preferable that the metal A is hard to be evaporated (volatile retardant metal), and the metal B is easy to be evaporated (volatile metal). The objective intermetallic compound $A_{m0}B_{n0}$ includes intermetallic compounds each having at least one constant ratio intermetallic compound $A_{m1}B_{n1}$ (n1/m1>n0/m0) composed of identical components, as a stable or metastable state. For example, $Nb_3Al$, which is an aluminide of niobium, has other stable phases represented by $Nb_2Al$ and $NbAl_3$, and $Nb_2Al$ has another stable phase represented by $NbAl_3$ in the same manner. In the present invention, the former ones may be an objective intermetallic compound, and the latter ones may be a starting material. Further, TiAl, which is an aluminide of titanium, has another stable state represented by $TiAl_3$. In this case, the former may be an objective intermetallic compound, and the latter may be a starting material. As for silicides of molybdenum, $Mo_3Si$ can be selected as an objective intermetallic compound, and $MoSi_2$ can be selected as a starting material. The foregoing intermetallic compounds are only exemplary. The object of the present invention is arbitrary intermetallic compounds composed of identical components and having a plurality of stable or metastable states. In another embodiment of the present invention, the starting material may contain an objective intermetallic compound $A_{m0}B_{n0}$ together with a constant ratio intermetallic compound $A_{m1}B_{n1}$ having a higher constitutional ratio of the metal B. By doing so, it is also possible to finally obtain the intermetallic compound $A_{m0}B_{n0}$ as a single-phase product. In still another embodiment, the starting material may contain a simple substance of the metal B. However, it may be difficult to control the composition because the metal B is preferentially volatilized. Therefore, it is desirable that the metal B (simple substance) contained in the starting material has a content of not more than 5% by weight.

The starting material $A_{m1}B_{n1}$ (n1/m1>n0/m0), which is used to perform the melting process by means of the electron beam according to the method for producing the intermetallic compound of the present invention, is obtainable in accordance with a variety of methods. For example, as depicted in an embodiment of the present invention described later on, the starting material can be produced as a compressed preparation obtained by treating a powder sample with CIP and HIP, or as a preparation obtained by once melting the compressed preparation subsequently in accordance with the arc button melt method in a pressurized atmosphere.

It is preferable that the melting process based on the use of the electron beam is repeated two or more times, in which at least one intermetallic compound $A_{m1}B_{n1}$ (n1/m1>n0/m0) having a constitutional ratio of the metal B higher than that of the intermetallic compound $A_{m0}B_{n0}$ is used as the starting material. The two or more times of repetition makes it possible to successively change the composition and the phase of the starting material, and adjust the composition by selecting the melting time or the energy supply as described later on. Further, the intermetallic compound can be melted more uniformly by performing the melting process two or more times.

In the present invention, the melting process is performed by irradiating the starting material with the electron beam. As for the atmosphere for the electron beam irradiation in this process, it is preferable to use a high vacuum atmosphere of not more than $9\times10^{-5}$ bar which allows irradiation with the electron beam and avoids contamination of impurities. Preferably, the heating temperature affected by the electron beam is not less than a temperature at which the stable phase as the starting material is decomposed, and not more than a temperature at which the objective stable phase is not decomposed. The relationship between the electron beam output and the temperature of a material or a sample to be heated can be previously measured. Thus, the heating temperature can be controlled by changing the electron beam output.

It has been found in the present invention that there is a correlation between the melting time based on the use of the electron beam and the composition of the intermetallic compound. Therefore, it is possible to obtain an intermetallic compound containing components in a desired ratio by changing the melting time or the energy supply on condition that the correlation is previously determined.

DETAILED DESCRIPTION OF THE PREFERRED EMBODIMENTS

Figure 1:
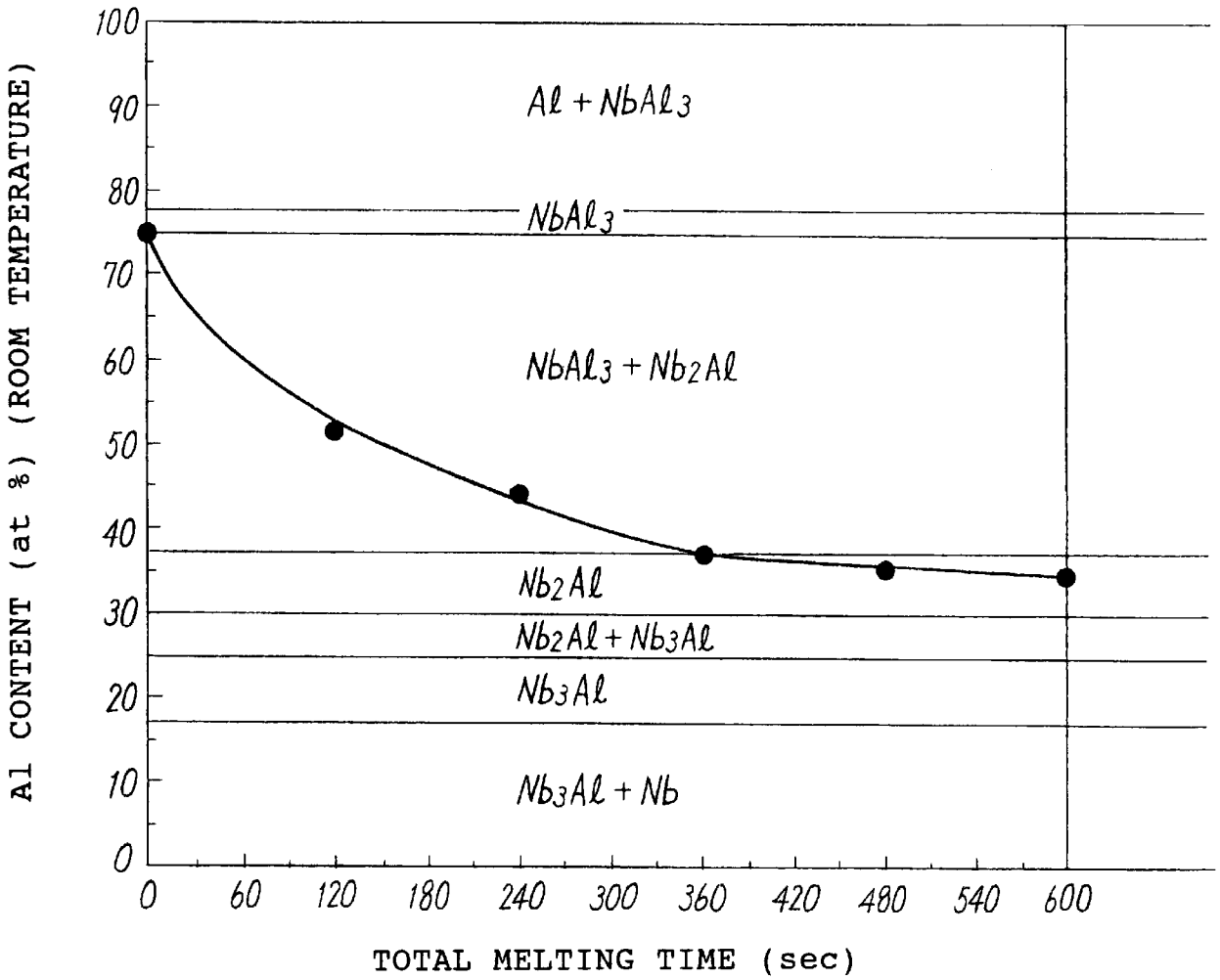
FIG. 1 shows a graph illustrating the Al concentration of samples obtained in accordance with the electron beam melt method in an embodiment of the present invention, and the phases of intermetallic compounds based on the Nb—Al system, in relation to the total melting time.
Figure 2:
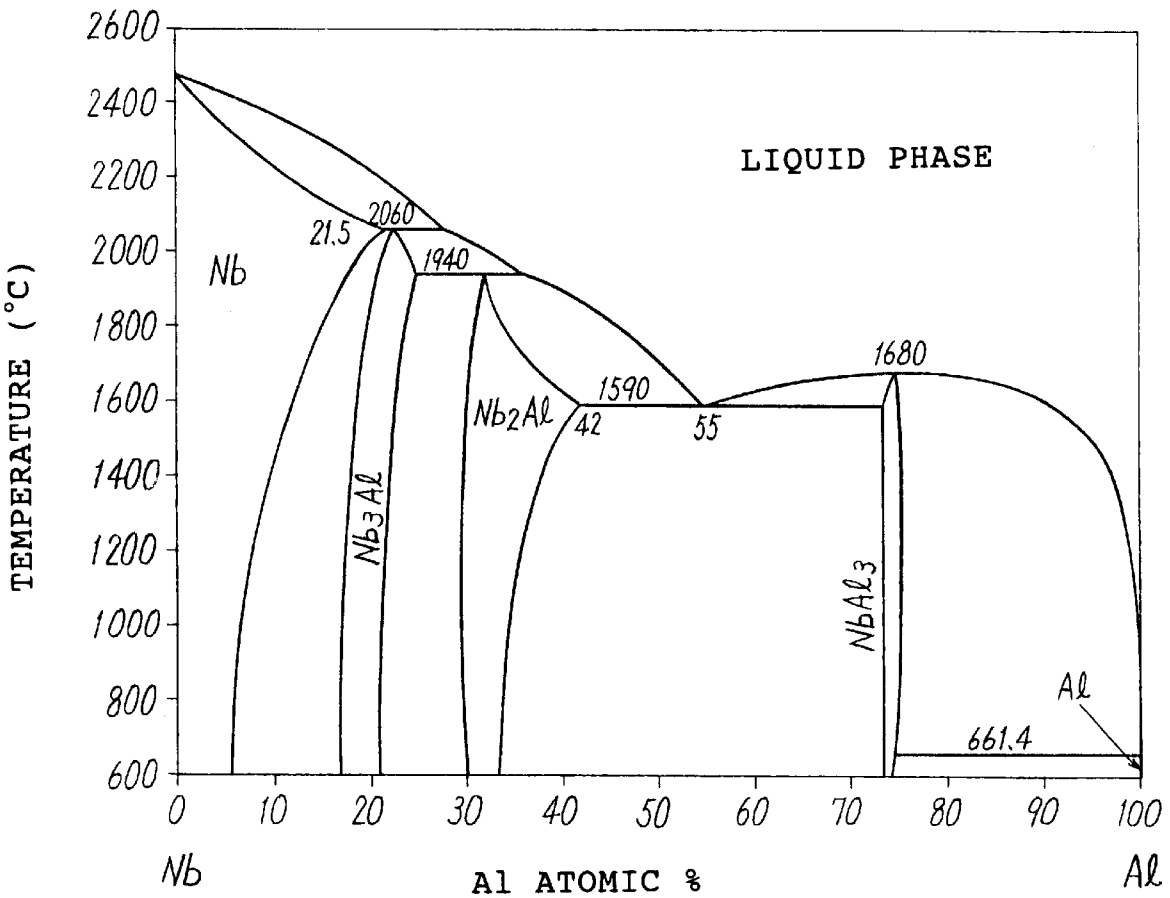
FIG. 2 shows a phase diagram illustrating stable or metastable states of the Nb—Al system.

The method for producing the intermetallic compound of the present invention will be described in detail below in accordance with embodiments and examples.

<Preparation of Starting Material>

Powder samples of Nb and Al were mixed to give an atomic % of Nb: Al=1:3, followed by CIP and HIP treatments. The HIP treatment was performed for 1 hour at a temperature of 650° C. and a pressure of $1.2\times10^7$ kg/m$^2$. Subsequently, a heat treatment was performed at a temperature of about 1000° C. in a vacuum atmosphere of $3\times10^{-5}$ bar, followed by quick cooling with water to obtain a compressed sample preparation of Nb—Al. The crystal structure of this sample was observed by using a powder X-ray diffraction apparatus (PW1700 produced by Philips; CuK $\alpha$-ray). As a result, it was confirmed that no single-phase was formed, and unreacted Nb was present.

In order to convert the unreacted Nb into an intermetallic compound, a melting process was performed in a pressurized atmosphere of Ar by using a plurality of compressed sample preparations prepared as described above, in accordance with the arc button melt method. The melting condition was as follows. Namely, the plasma output was controlled to be 160 (A) so that the unreacted Nb might be melted. The pressure of Ar gas was held at about 0.35 atm, and the melting time was changed by every 3 minutes up to 15 minutes. After completion of the arc button melt process, it was confirmed that large cracks appeared in all of the button samples, and each of the buttons was divided into two or three pieces.

Each of the buttons thus obtained in accordance with the arc button melt method was cut into a plate shape having a thickness of 3 mm, from a central portion of the button (piece) by using a fine cutter, followed by grinding into powder by using a mortar. The powder sample was subjected to crystal analysis by means of X-ray diffraction. As a result, it was found that the powder sample was composed of two phases of $NbAl_3$ and $Nb_2Al$. The average Al concentration was 69.28 atomic %. $NbAl_3$ and $Nb_2Al$ were contained in ratios of 14.26% and 85.74% respectively. The button was used as a starting material for synthesizing an intermetallic compound in accordance with the electron beam melting process.

<Synthesis of Intermetallic Compound in Accordance with Electron Beam Melting Process>

Five of the buttons ($NbAl_3$+$Nb_2Al$) were prepared as the starting material obtained as described above. The buttons were melted for various melting times in accordance with the melting method based on the electron beam button melt process. The electron beam output was 0.2 (A) in a vacuum atmosphere of $6.7\times10^{-5}$ atm. At first, the upper surface of the button was irradiated with the electron beam to cause melting. After solidification, the button was turned upside down to melt the button with an identical irradiation time. The five buttons (Sample Nos. 1 to 5) were treated for total melting times (for two times of melting) of 120, 240, 360, 480, and 600 seconds respectively. Table 1 shows the total melting time (sec) of each of the samples, the initial weight of the button (g), the weight of the button after melting (g), and the of weight loss δ (%).

TABLE 1

| | Melting condition | | | Weight change | | |
|---|---|---|---|---|---|---|
| Sample No. | Output (A) | Total melting time (sec) | Pressure (atm) | Initial (g) | After melting (g) | ΔW % |
| 1 | 0.2 | 120 | $6.7\times10^{-5}$ | 16.99 | 12.87 | 24.3 |
| 2 | 0.2 | 240 | $6.7\times10^{-5}$ | 16.77 | 11.74 | 30.0 |
| 3 | 0.2 | 360 | $6.7\times10^{-5}$ | 16.97 | 11.16 | 34.3 |
| 4 | 0.2 | 480 | $6.7\times10^{-5}$ | 16.89 | 10.62 | 37.2 |
| 5 | 0.2 | 600 | $6.7\times10^{-5}$ | 16.03 | 10.69 | 33.3 |

The buttons of Sample Nos. 1 to 5 subjected to the electron beam melting process were ground to identify their phases by means of powder X-ray diffraction respectively. The Al concentration was measured for each of them by means of ICP elementary analysis.

<Results of Powder X-Ray Diffraction>

In a powder X-ray diffraction pattern of Sample No. 1, representative peaks of $NbAl_3$ appeared in the vicinity of diffraction angles of about 21, 25, 40, and 47 degrees, and representative peaks of $Nb_2Al$ appeared in the vicinity of diffraction angles of about 37, 38, 39, 41, 42, 43, 46, 70.5, 71, 73, and 82.5 degrees. Therefore, it was found that Sample No. 1 was composed of two phases of $NbAl_3$ and $Nb_2Al$ in the same manner as the starting material. X-ray diffraction peaks corresponding to $NbAl_3$ and $Nb_2Al$ were also appeared for Sample No. 2 in the same manner as described above. However, according to intensities of the peaks, it was assumed that Sample No. 2 had a larger ratio of $Nb_2Al$ than Sample No. 1. This fact was also supported by ICP elementary analysis.

In a powder X-ray diffraction pattern of Sample No. 3, peaks corresponding to $Nb_2Al$ appeared, however, no peak indicating $NbAl_3$ appeared. Accordingly, it was assumed that Sample No. 3 was substantially composed of a single-phase of $Nb_2Al$.

According to a powder X-ray diffraction pattern of Sample No. 4, peaks corresponding to $Nb_2Al$ were observed, however, two peaks in the vicinity of 39 degrees inherent in $Nb_2Al$ were not observed in a separated manner. Judging from the fact that a peak having the strongest intensity ratio inherent in $Nb_2Al$ might appear at about 39 degrees, it was assumed that Sample No. 4 contained not only the $Nb_2Al$ phase but also an extremely slight amount of the $Nb_3Al$ phase.

According to a powder X-ray diffraction pattern of Sample No. 5, it was identified that Sample No. 5 was composed of a single-phase of $Nb_2Al$. Table 2 shows results of identification of Sample Nos. 1 to 5 by means of powder X-ray diffraction, and results of measurement of the Al concentration by means of ICP elementary analysis.

TABLE 2

| Sample No. | Initial Al content (at %) | Melting time (sec) | Result of analysis ICP | Result of analysis X-ray diffraction |
|---|---|---|---|---|
| 1 | 75.0 | 120 | 51.54 | $Nb_2Al$ + $NbAl_3$ |
| 2 | 75.0 | 240 | 44.04 | $Nb_2Al$ + $NbAl_3$ |
| 3 | 75.0 | 360 | 37.06 | $Nb_2Al$ |
| 4 | 75.0 | 480 | 35.24 | $Nb_2Al$ + $Nb_3Al$ |
| 5 | 75.0 | 600 | 34.70 | $Nb_2Al$ |

FIG. 1 shows the Al concentration of the samples obtained in accordance with the electron beam melt method and the phases of intermetallic compounds for constructing the samples, in relation to the total melting time. According to FIG. 1, the Al concentration changes in relation to the melting time such that the Al concentration is decreased in a manner of exponential function during an initial period of melting, exhibiting linear decrease from the vicinity of a melting time of about 120 seconds, and arriving at the $Nb_2Al$ single-phase at about 480 seconds.

According to the result shown in FIG. 1, it is suggested that the $Nb_3Al$ single-phase can be synthesized by using $Nb_2Al$ and $Nb_3Al$ as starting materials, setting the electron beam output so that the system may be heated to an intermediate temperature, for example, about 1925° C. between a peritectic temperature of $Nb_3Al$ of 1960° C. and a peritectic temperature of $Nb_2Al$ of 1890° C., and performing the melting process by using the irradiation time (melting time) as a parameter.

It is noted that emission of blue light was observed during the melting of the starting material in accordance with the electron beam melt method described above. It is assumed that this phenomenon is caused as follows. Namely, compounds containing oxygen or nitrogen such as $Al_2O_3$ are formed during the arc button melt process, for example, by reactions between Al in the matrix and oxygen in the atmosphere or the sample. Oxygen or nitrogen contained in such compounds is adsorbed by Al evaporating during the electron beam melt process, and it is removed from the system together with Al, during which the blue light is emitted. This fact can be also postulated from the fact that the button produced by the arc melt process had cracks, while the button produced by the electron beam melt process had no crack. Therefore, it is approved that the method for producing the intermetallic compound of the present invention also provides a purification effect for removing impurities.

According to the method for producing the intermetallic compound of the present invention, the intermetallic compound $A_{m1}B_{n1}$ having a large constitutional ratio of the metal B is used as a starting material so that its composition may be gradually changed. Therefore, the stoichiometric ratio of the components of the objective intermetallic compound $A_{m0}B_{n0}$ is easily adjusted. Moreover, the method of the present invention also provides the effect of purification for removing impurities. Therefore, the present invention can be used to obtain the intermetallic compound such as $Nb_3Al$ having a desired composition in a high purity. The present invention may be practiced or embodied in other various forms without departing from the spirit or essential characteristics thereof. It will be understood that the scope of the present invention is indicated by the appended claims, and all variations and modifications concerning, for example, the use of a mixed phase of stable and metastable phases in the starting material, the presence or absence of an objective intermetallic compound in the starting material, and the presence or absence of the metal B in the starting material, which come within the equivalent range of the claims, are embraced in the scope of the present invention.

What is claimed is:

1. A method for producing an intermetallic compound $A_{m0}N_{n0}$ composed of a metal A and a metal B, comprising the steps of:

providing, as a starting material, at least one intermetallic compound $A_{m1}B_{n1}$ (n1/m1>n0/m0) having a constitutional ratio of the metal B higher than that of the intermetallic compound $A_{m0}B_{n0}$; and melting the intermetallic compound $A_{m1}B_{n1}$, while controlling a melting temperature to be not less than a decomposition termperature of the intermetallic compound $A_{m1}B_{n1}$ and not more than a decomposition temperature of the intermetallic compound $A_{m0}B_{n0}$, by means of an electron beam to obtain the intermetallic compound $A_{m0}B_{n0}$.

2. The method according to claim 1, wherein the metal A is hard to evaporate, and the metal B is easy to evaporate.

3. The method according to claim 1, wherein the melting step by means of the electron beam is repeated two or more times.

4. The method according to claim 1, wherein the obtained intermetallic compound has a desired composition by selecting a melting time or energy supply for the melting step by means of the electron beam.

5. The method according to claim 1, wherein the starting material is prepared by means of an arc melt melting method.

6. The method according to claim 1, wherein the starting material contains the metal B as a simple substance at a content of not more than 5 atomic %.

7. The method according to claim 1, wherein the intermetallic compound $A_{m0}B_{n0}$ is $Nb_2Al$, and the intermetallic compound $A_{m1}B_{n1}$ is $NbAl_3$.

8. The method according to claim 1, wherein the intermetallic compound $A_{m0}B_{n0}$ is TiAl, and the intermetallic compound $A_{m1}B_{n1}$ is $TiAl_3$.

9. The method according to claim 1, wherein the intermetallic compound $A_{m0}B_{n0}$ is $Mo_3Si$, and the intermetallic compound $A_{m1}B_{n1}$ is $MoSi_2$.

10. A method for producing an intermetallic compound $A_{m0}B_{n0}$ composed of a metal A and a metal B, comprising the steps of:

providing, as a starting material, a mixture of the intermetallic compound $A_{m0}B_{n0}$ and at least one intermetallic compound $A_{m1}B_{n1}$ (n1/m1>n0/m0) having a constitutional ratio of the metal B higher than that of the intermetallic compound $A_{m0}B_{n0}$; and melting the starting material, while controlling a melting temperature to be not less than a decomposition temperature of the intermetallic compound $A_{m1}B_{n1}$ and not more than a decomposition temperature of the intermetallic compound $A_{m0}B_{n0}$, by means of an electron beam to produce the intermetallic compound $A_{m0}B_{n0}$ having as a single-phase product.

11. The method according to claim 10, wherein the metal A is hard to evaporate, and the metal B is easy to evaporate.

12. The method according to claim 10, wherein the melting step by means of the electron beam is repeated two or more times.

13. The method according to claim 10, wherein the obtained intermetallic compound has a desired composition by selecting a melting time or energy supply for the melting step by means of the electron beam.

14. The method according to claim 10, wherein the starting material is prepared by means of an arc melt melting method.

15. The method according to claim 10, wherein the intermetallic compound $A_{m0}B_{n0}$ is $Nb_2Al$, the intermetallic compound $A_{m1}B_{n1}$ is $NbAl_3$, and the starting material to be used contains $NbAl_3$ and $Nb_2Al$.

16. The method according to claim 15, wherein the starting material containing $NbAl_3$ and $Nb_2Al$ is prepared by treating a mixed powder sample of Nb and Al with CIP and HIP, followed by performing an arc button melt process.

17. The method according to claim 10, wherein the intermetallic compound $A_{m0}B_{n0}$ is $Nb_3Al$, and the starting material to be used contains $Nb_3Al$ and $Nb_2Al$.

18. The method according to claim 17, wherein a melting temperature affected by the electron beam is adjusted to be a temperature between a peritectic temperature of $Nb_3Al$ and a peritectic temperature of $Nb_2Al$.

19. The method according to claim 18, wherein $Nb_3Al$ is produced as a single-phase product by controlling a melting time.

* * * * *

UNITED STATES PATENT AND TRADEMARK OFFICE

CERTIFICATE OF CORRECTION

PATENT NO. : 5,972,133

DATED : October 26, 1999

INVENTOR(S) : Syozo KAMBARA

It is certified that error appears in the above-identified patent and that said Letters Patent is hereby corrected as shown below:

Please add category "[30] Foreign Application Priority Data" as follows:

-- [30] Foreign Application Priority Data

April 23, 1996 [JP] Japan ..... 8-126402 --.

Signed and Sealed this

Seventeenth Day of April, 2001

*Attest:*

*Attesting Officer*

NICHOLAS P. GODICI

*Acting Director of the United States Patent and Trademark Office*